US009428989B2

(12) United States Patent
Aitken et al.

(10) Patent No.: US 9,428,989 B2
(45) Date of Patent: Aug. 30, 2016

(54) SUBTERRANEAN WELL INTERVENTIONLESS FLOW RESTRICTOR BYPASS SYSTEM

(71) Applicant: HALLIBURTON ENERGY SERVICES, INC., Houston, TX (US)

(72) Inventors: Liam A. Aitken, Plano, TX (US); Nicholas A. Kuo, Dallas, TX (US); Gregory S. Cunningham, Grapevine, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 428 days.

(21) Appl. No.: 13/742,053

(22) Filed: Jan. 15, 2013

(65) Prior Publication Data

US 2013/0186626 A1 Jul. 25, 2013

(30) Foreign Application Priority Data

Jan. 20, 2012 (WO) ..... PCT/US2012/022043

(51) Int. Cl.
*E21B 34/06* (2006.01)
*E21B 43/08* (2006.01)
*E21B 34/08* (2006.01)

(52) U.S. Cl.
CPC ..... *E21B 34/06* (2013.01); *E21B 34/085* (2013.01); *E21B 43/08* (2013.01)

(58) Field of Classification Search
CPC .... E21B 34/063; E21B 34/066; E21B 34/08; E21B 34/06; E21B 43/08; E21B 43/12; F16K 17/40; F16K 13/04; F16K 17/383; F16K 3/26
See application file for complete search history.

(56) References Cited

U.S. PATENT DOCUMENTS

| | | | |
|---|---|---|---|
| 3,272,641 | A | 9/1966 | Ehrlich |
| 4,157,732 | A | 6/1979 | Fonner |
| 5,048,334 | A | 9/1991 | Hampton et al. |
| 5,622,211 | A | 4/1997 | Martin et al. |
| 6,092,604 | A | 7/2000 | Rice et al. |
| 6,125,933 | A | 10/2000 | Ross |

(Continued)

FOREIGN PATENT DOCUMENTS

| | | | |
|---|---|---|---|
| CN | 101421486 | B | 9/2013 |
| EP | 0791290 | A2 | 8/1997 |

(Continued)

OTHER PUBLICATIONS

Office Action issued Apr. 24, 2013 for U.S. Appl. No. 13/666,345, 23 pages.

(Continued)

*Primary Examiner* — Cathleen Hutchins
(74) *Attorney, Agent, or Firm* — Locke Lord LLP

(57) ABSTRACT

A method of variably restricting flow in a subterranean well can include resisting flow through a flow path, and then selectively opening a pressure barrier which previously prevented flow through another flow path. The flow paths are configured for parallel flow. A flow restrictor system for use with a subterranean well can include at least two flow paths configured for parallel flow, a flow restrictor which resists flow through one flow path, and a pressure barrier which prevents flow through another flow path. The pressure barrier is selectively openable to permit flow through the second flow path.

23 Claims, 7 Drawing Sheets

(56) References Cited

U.S. PATENT DOCUMENTS

| | | | | |
|---|---|---|---|---|
| 6,622,794 | B2 | 9/2003 | Zisk, Jr. | |
| 7,044,229 | B2 | 5/2006 | Tennoy et al. | |
| 7,048,057 | B2 | 5/2006 | Bearden et al. | |
| 7,387,165 | B2 | 6/2008 | Lopez De Cardenas et al. | |
| 7,543,641 | B2 | 6/2009 | Contant | |
| 7,699,101 | B2 | 4/2010 | Fripp et al. | |
| 7,819,194 | B2 | 10/2010 | Tips | |
| 7,913,765 | B2 * | 3/2011 | Crow et al. | 166/373 |
| 2003/0070809 | A1 | 4/2003 | Schultz et al. | |
| 2003/0111224 | A1 | 6/2003 | Hailey, Jr. et al. | |
| 2004/0144544 | A1 | 7/2004 | Freyer | |
| 2005/0092488 | A1 * | 5/2005 | Rodet et al. | 166/278 |
| 2007/0144731 | A1 | 6/2007 | Murray et al. | |
| 2008/0283238 | A1 * | 11/2008 | Richards et al. | 166/228 |
| 2009/0008092 | A1 | 1/2009 | Haeberle et al. | |
| 2009/0084556 | A1 * | 4/2009 | Richards | E21B 43/086 166/329 |
| 2009/0151925 | A1 | 6/2009 | Richards et al. | |
| 2009/0283322 | A1 | 11/2009 | Dove | |
| 2010/0175867 | A1 | 7/2010 | Wright et al. | |
| 2011/0043099 | A1 | 2/2011 | Duan et al. | |
| 2011/0247833 | A1 | 10/2011 | Todd et al. | |

FOREIGN PATENT DOCUMENTS

| | | | |
|---|---|---|---|
| WO | 2004048748 | A1 | 6/2004 |
| WO | 2008053364 | A2 | 5/2008 |

OTHER PUBLICATIONS

Gas Technology; "A Proven Gas-Well Completion Technique for Higher Deliverability", SPE1002, dated Mar. 15, 1965, 10 pages.

Society of Petroleum Engineers of Aime; "Maximum Differential Pressure Perforating", SPE 2648, dated Sep. 1-Oct. 1, 1969, 8 pages.

International Fishing Devices, Inc., "Commercial Applications," dated 2005, 2 pages.

International Fishing Devices, Inc., "Galvanic Underwater Releases," dated 2005, 1 page.

Office Action issued Feb. 12, 2009 for U.S. Appl. No. 11/635,159, 8 pages.

Office Action issued Jul. 9, 2009 for U.S. Appl. No. 11/635,159, 6 pages.

International Search Report with Written Opinion issued Sep. 25, 2012 for PCT Patent Application No. PCT/US12/022040, 8 pages.

International Search Report with Written Opinion issued Nov. 23, 2012 for PCT Patent Application No. PCT/US12/022043, 13 pages.

Specification and Drawings for U.S. Appl. No. 14/127,069, filed Nov. 1, 2012, 25 pages.

Canadian Office Action dated Oct. 2, 2015, issued during the prosecution of corresponding Canadian Patent Application No. 2,858,976 (3 pages).

Singapore Search Report and Written Opinion dated May 27, 2015, issued on corresponding Singapore Patent Application No. 11201403170S.

Australian Patent Examination Report No. 1 dated May 20, 2015, issued on corresponding Australian Patent Application No. 2012366214.

Chinese Office Action and English translation thereof, dated Dec. 29, 2015, issued on corresponding Chinese Patent Application No. 20120067365.5.

Extended European Search Report dated Jun. 28, 2016, issued during the prosecution of corresponding European Patent Application No. 12865773.1.

* cited by examiner

SUBTERRANEAN WELL INTERVENTIONLESS FLOW RESTRICTOR BYPASS SYSTEM

CROSS-REFERENCE TO RELATED APPLICATION

This application claims the benefit under 35 USC §119 of the filing date of International Application Serial No. PCT/US12/22043 filed 20 Jan. 2012. The entire disclosure of this prior application is incorporated herein by this reference.

BACKGROUND

This disclosure relates generally to equipment utilized and operations performed in conjunction with a subterranean well and, in one example described below, more particularly provides a flow restrictor bypass system which does not require intervention into the well.

It is frequently desirable to restrict flow into a tubular string from one or more productive zones penetrated by a wellbore. However, it may become desirable at a future date to cease restricting flow into the tubular string, so that flow into the tubular string is relatively unrestricted.

For this reason and others, it will be appreciated that improvements are continually needed in the art of variably restricting flow in a subterranean well.

SUMMARY

In this disclosure, systems and methods are provided which bring improvements to the art of variably restricting flow in a subterranean well. One example is described below in which a bypass flow path around a flow restrictor is opened when it is desired to no longer restrict the flow (or to at least substantially decrease a restriction to the flow). Another example is described below in which the bypass flow path is opened after flow is initially restricted by the flow restrictor.

A method of variably restricting flow in a subterranean well is provided to the art by this disclosure. In one example, the method can include resisting flow through a flow path; and then selectively opening a pressure barrier which previously prevented flow through another flow path. The flow paths are configured for parallel flow.

A flow restrictor system for use with a subterranean well is also described below. In one example, the system can include at least two flow paths configured for parallel flow, a flow restrictor which resists flow through one flow path, and a pressure barrier which prevents flow through another flow path. The pressure barrier is selectively openable to permit flow through the second flow path.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
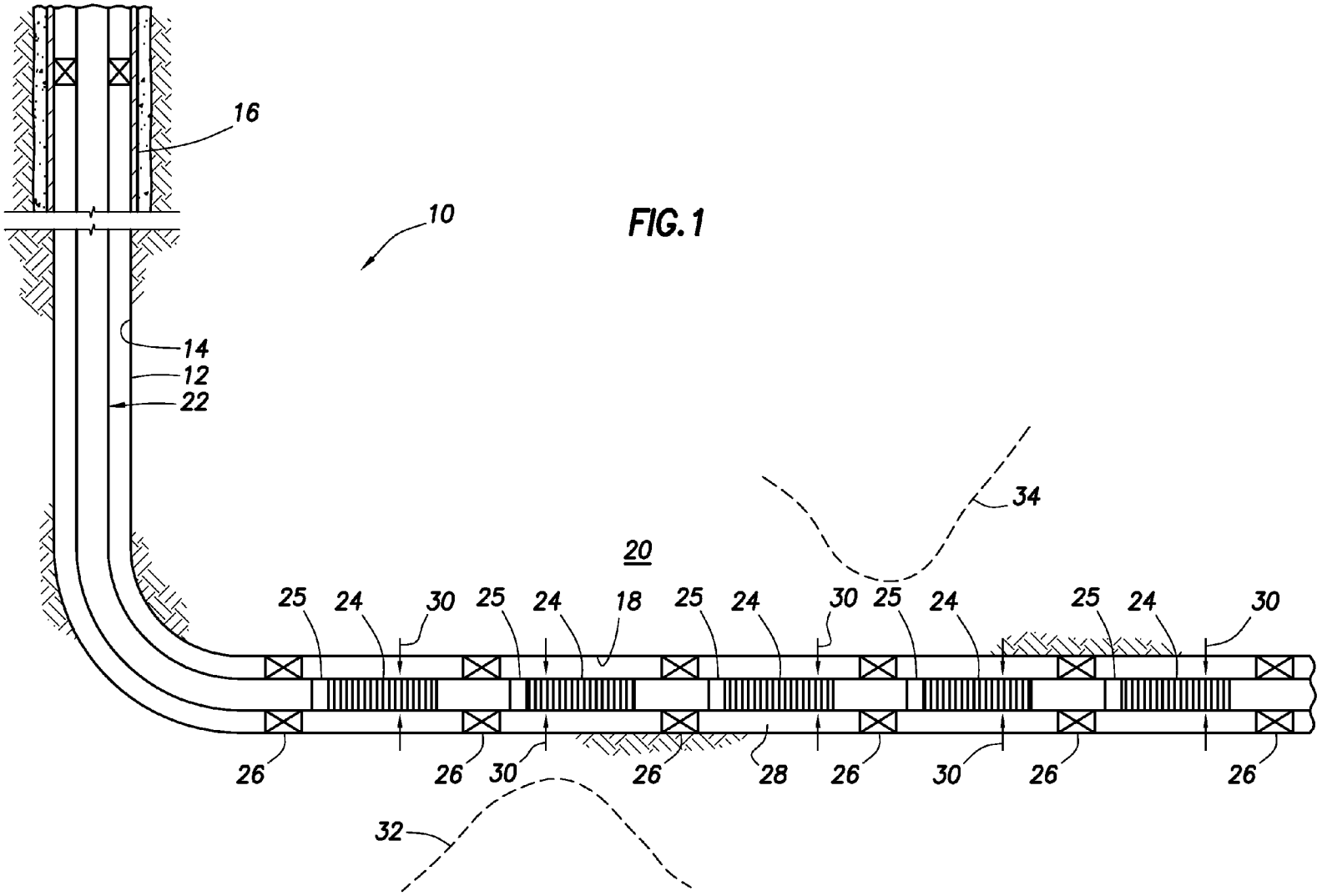
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. As depicted in FIG. 1, a wellbore 12 in the system 10 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow restrictor systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow restrictor system 25 are interconnected in the tubular string 22. The well screen 24 filters the fluids 30 flowing into the tubular string 22 from the annulus 28. The variable flow restrictor system 25 initially restricts flow of the fluids 30 into the tubular string 22.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow restrictor system 25 to be positioned between each adjacent pair of the packers 26. It is not necessary for a single variable flow restrictor system 25 to be used in conjunction with a single well screen 24. Any number, arrangement and/or combination of these components may be used.

It is not necessary for any variable flow restrictor system 25 to be used with a well screen 24. For example, in injection operations, the injected fluid could be flowed through a variable flow restrictor system 25, without also flowing through a well screen 24.

It is not necessary for the well screens 24, variable flow restrictor systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the scope of the disclosure is not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow restrictor systems 25 described more fully below can provide these benefits by restricting flow (e.g., to thereby balance flow among zones, prevent water or gas coning, restrict flow of an undesired fluid such as water or gas in an oil producing well, etc.). However, when it is no longer desired to restrict the flow of the fluid 30, one or more parallel bypass flow paths can be opened, so that relatively unrestricted flow of the fluid into (or out of) the tubular string 22 is permitted.

Figure 2:
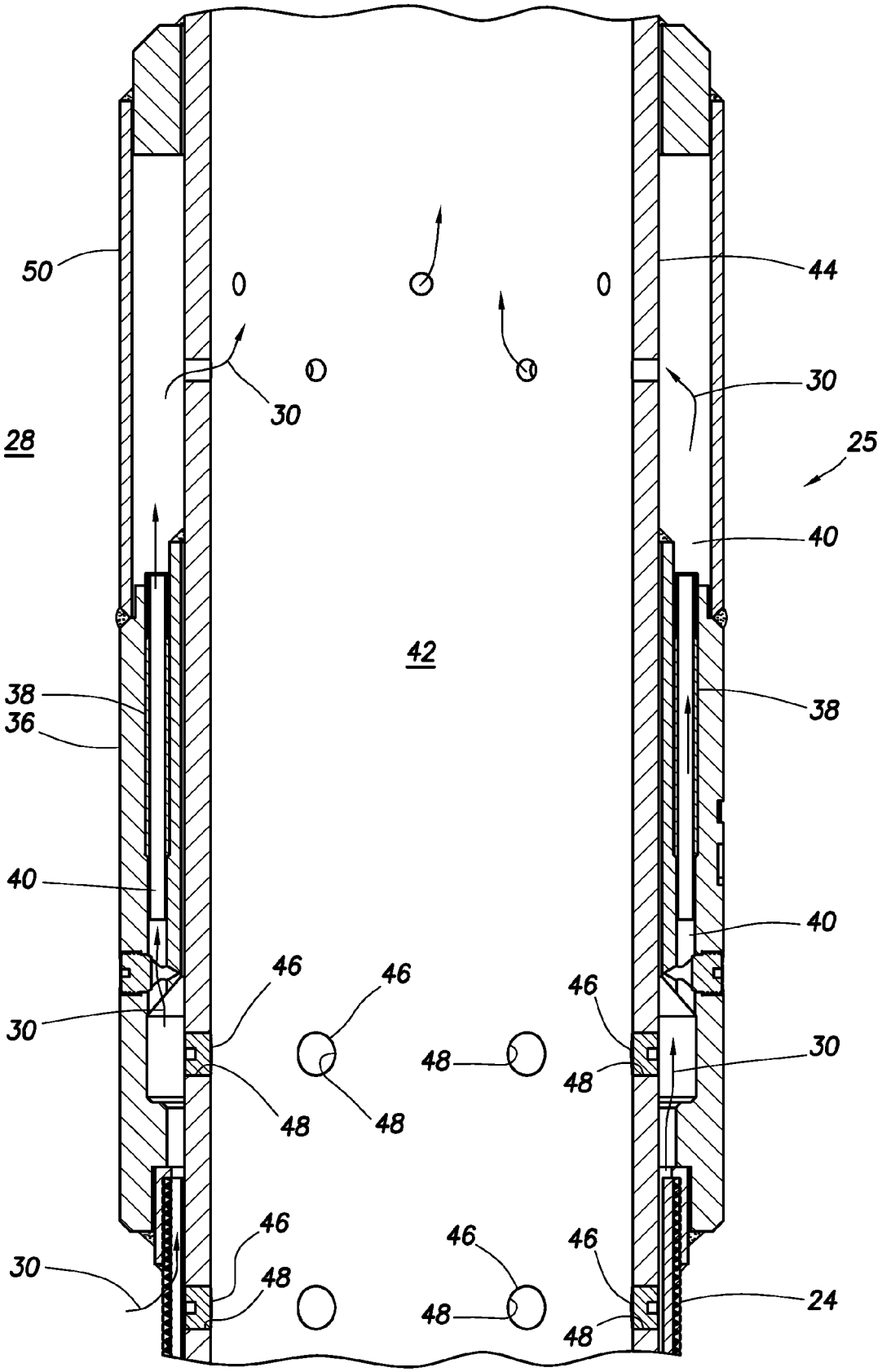
FIG. 2 is an enlarged scale representative cross-sectional view of a variable flow restrictor system which may be used in the well system and method of FIG. 1.

Referring additionally now to FIG. 2, an enlarged scale cross-sectional view of one example of the variable flow restrictor system 25 is representatively illustrated. In this example, the fluid 30 flows through the screen 24, and is thereby filtered, prior to flowing into a housing 36 of the system 25.

Secured in the housing 36 are one or more generally tubular flow restrictors 38 which restrict flow of the fluid 30 through the housing. Other types of flow restrictors (such as orifices, tortuous flow paths, vortex chambers, etc.) may be used, if desired. The scope of this disclosure is not limited to any particular type, number or combination of flow restrictors.

The flow restrictors 38 form sections of flow paths 40 extending between the annulus 28 on an exterior of the system 25 to an interior flow passage 42 extending longitudinally through a base pipe 44 of the screen 24 and system 25. The base pipe 44 can be configured for interconnection in the tubular string 22, in which case the flow passage 42 will extend longitudinally through the tubular string, as well.

Pressure barriers 46 close off additional flow paths 48 which are parallel to the flow paths 40. The flow paths 40, 48 are "parallel," in that they can each be used to conduct the fluid 30 from one place to another, but the fluid does not have to flow through one before it flows through the other (i.e., the flow paths are not in series).

In the FIG. 2 example, one set of the pressure barriers 46 is in the base pipe 44 within the housing 36, and another set of the pressure barriers is in the base pipe within the screen 24. However, in practice only one of these sets may be used, and it should be clearly understood that the scope of this disclosure is not limited to any particular location of the pressure barriers 46.

Flow through the flow paths 48 is prevented, until the pressure barriers 46 are opened. Any technique for opening the flow paths 48 may be used (e.g., dissolving or degrading a plug, breaking a plug, oxidizing a pyrotechnic material, opening a valve, etc.). Several ways of opening the flow paths 48 are described below, but it should be clearly understood that the scope of this disclosure is not limited to any particular way of opening the flow paths.

When the flow paths 48 are opened, the fluid 30 can flow relatively unrestricted from the screen 24, through the flow paths, and into the passage 42. Thus, flow between the interior and the exterior of the system 25 is not restricted substantially by the flow restrictors 38, although since the flow restrictors are in parallel with the flow paths 48, there will be some flow through the restrictors. However, this flow through the restrictors 38 will be minimal, because the fluid 30 will tend to flow more through the less restrictive flow paths 48 (e.g., the paths of least resistance).

In the FIG. 2 example, the flow paths 48 are formed through a wall of the base pipe 44. However, other locations for the flow paths 48 may be used, if desired.

Figure 3:
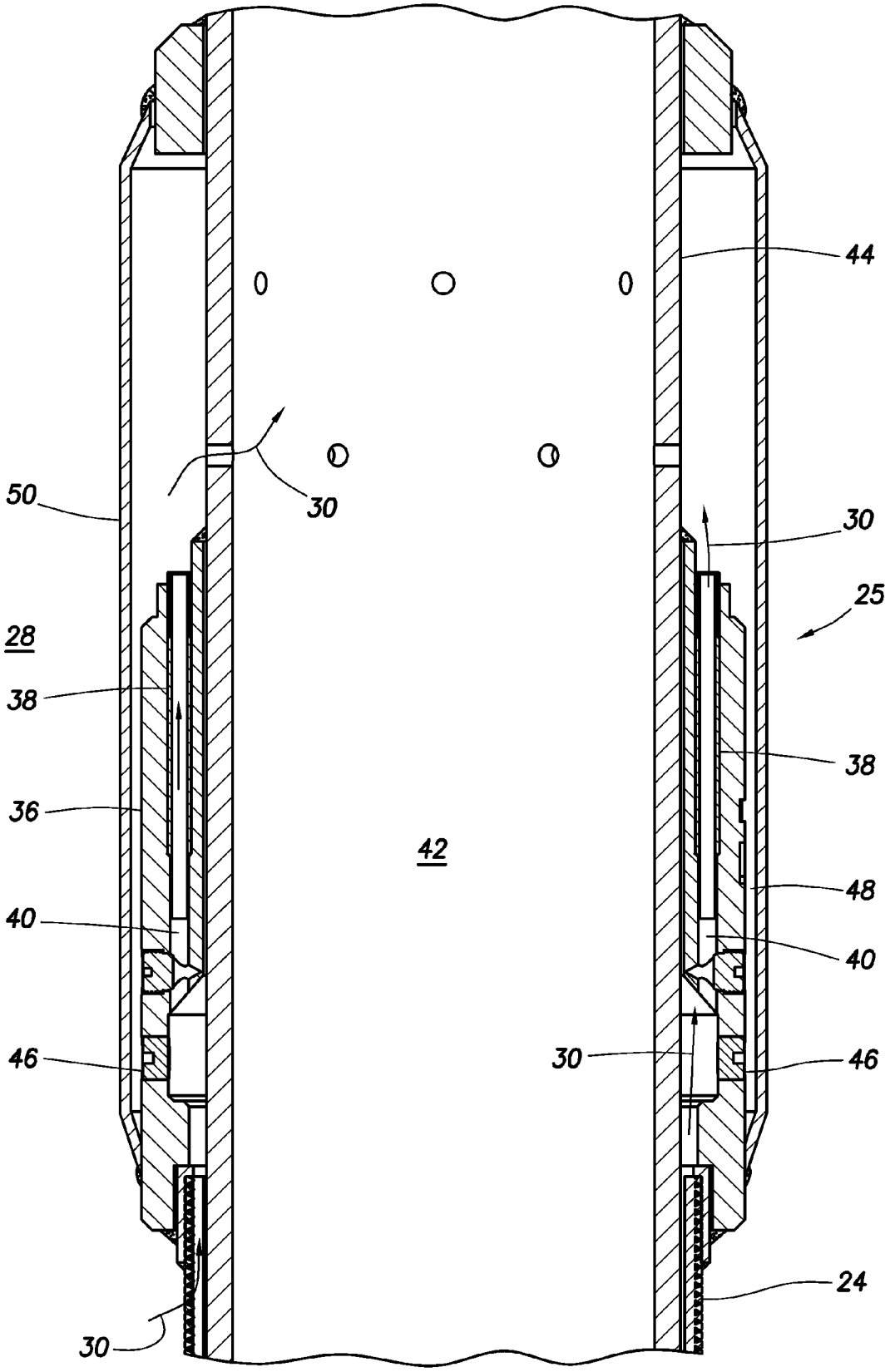
FIG. 3 is a representative cross-sectional view of another example of the variable flow restrictor system.

In FIG. 3, another example of the system 25 is representatively illustrated, in which the flow path 48 comprises an annular space formed between the housing 36 and an outer sleeve 50. The pressure barriers 46 are positioned in the housing 36, preventing the fluid 30 from flowing from the screen 24 through the flow path 48.

Figure 4:
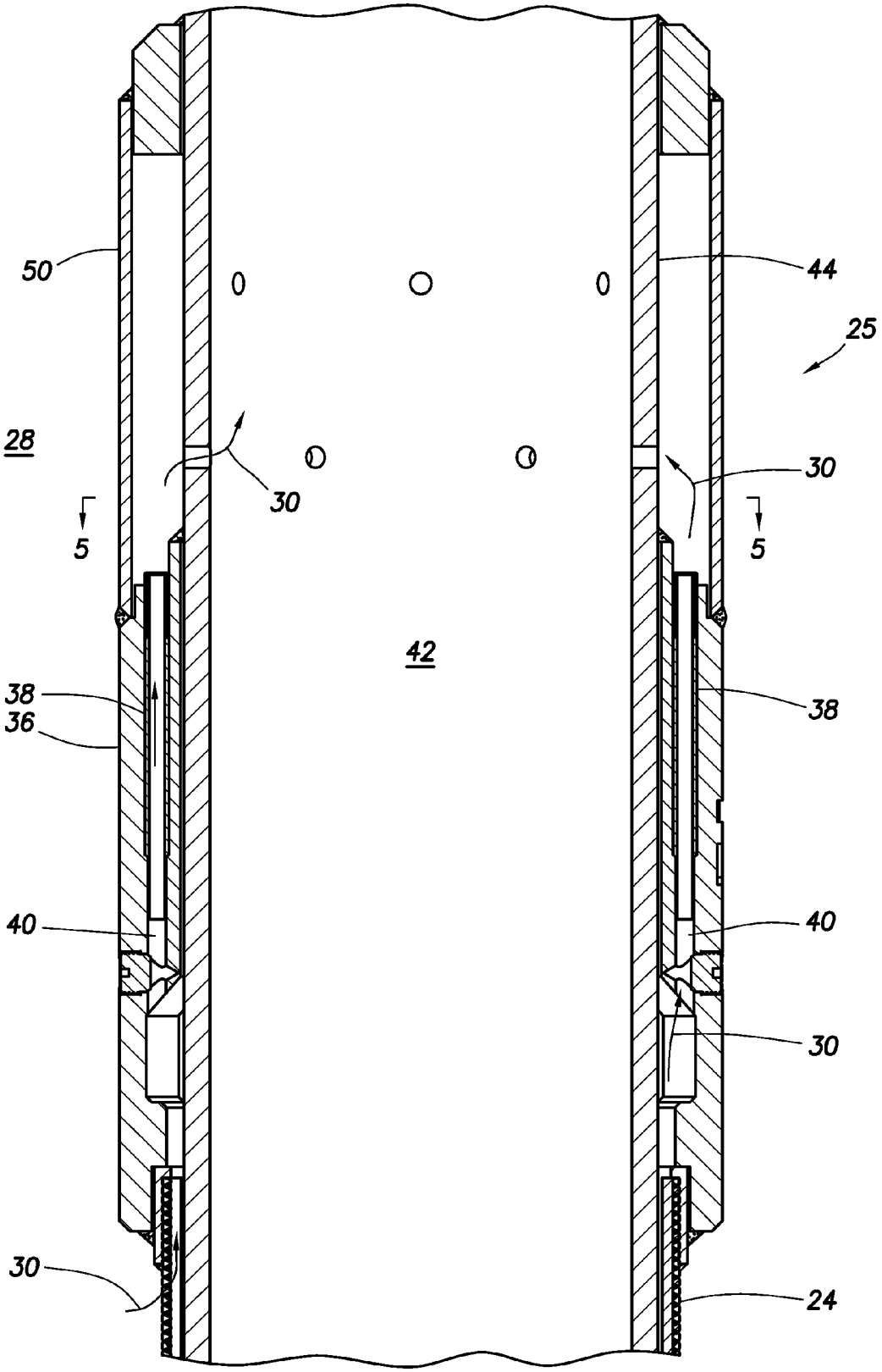
FIG. 4 is a representative cross-sectional view of another example of the variable flow restrictor system.
Figure 5:
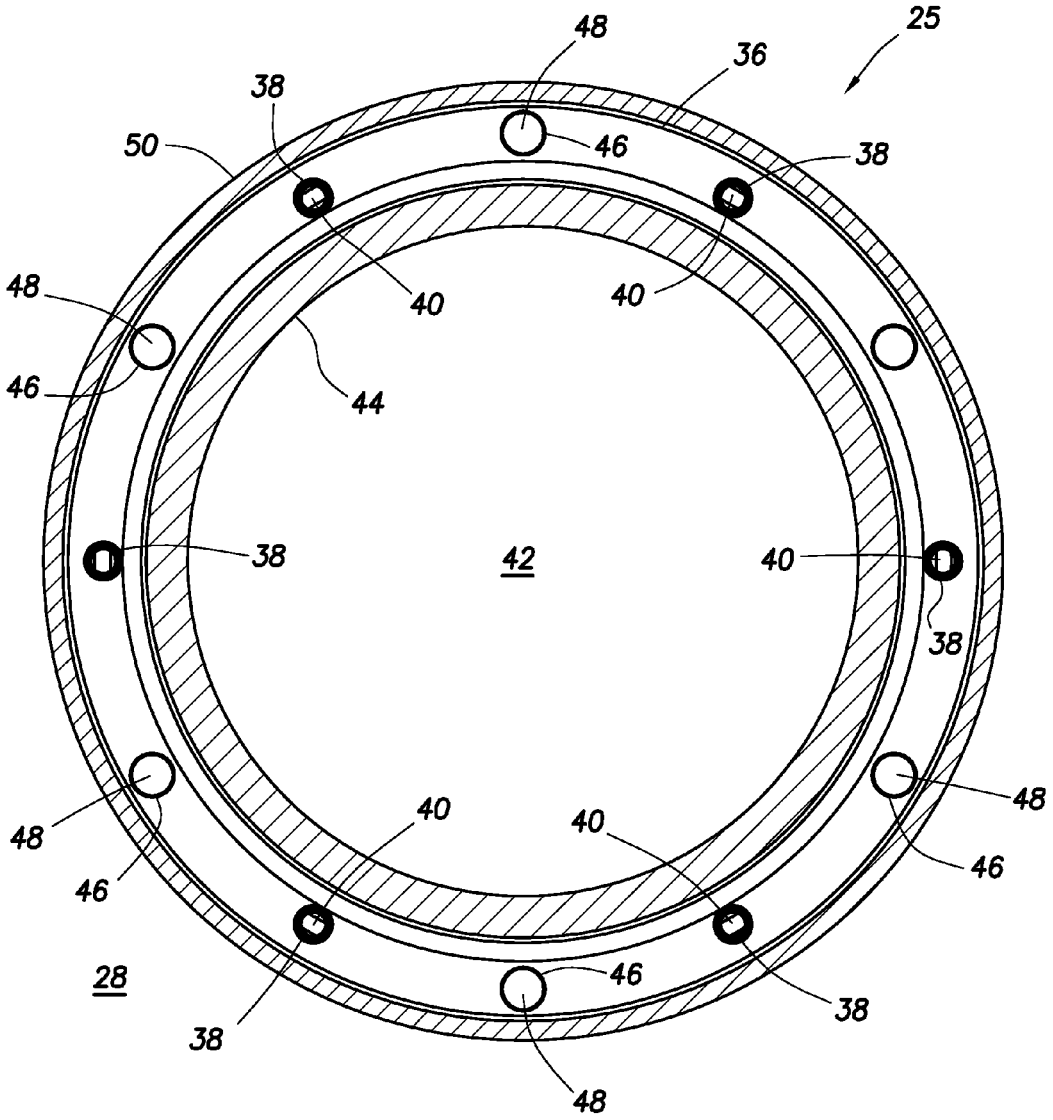
FIG. 5 is a further enlarged scale representative cross-sectional view of the variable flow restrictor system, taken along line 5-5 of FIG. 4.

In FIGS. 4 & 5, the pressure barriers 46 are positioned in an upper end of the housing 36. In this example, the flow paths 40, 48 are geometrically parallel (in that they all extend longitudinally in the housing) and are circumferentially offset from each other in the housing 36.

Figure 6:
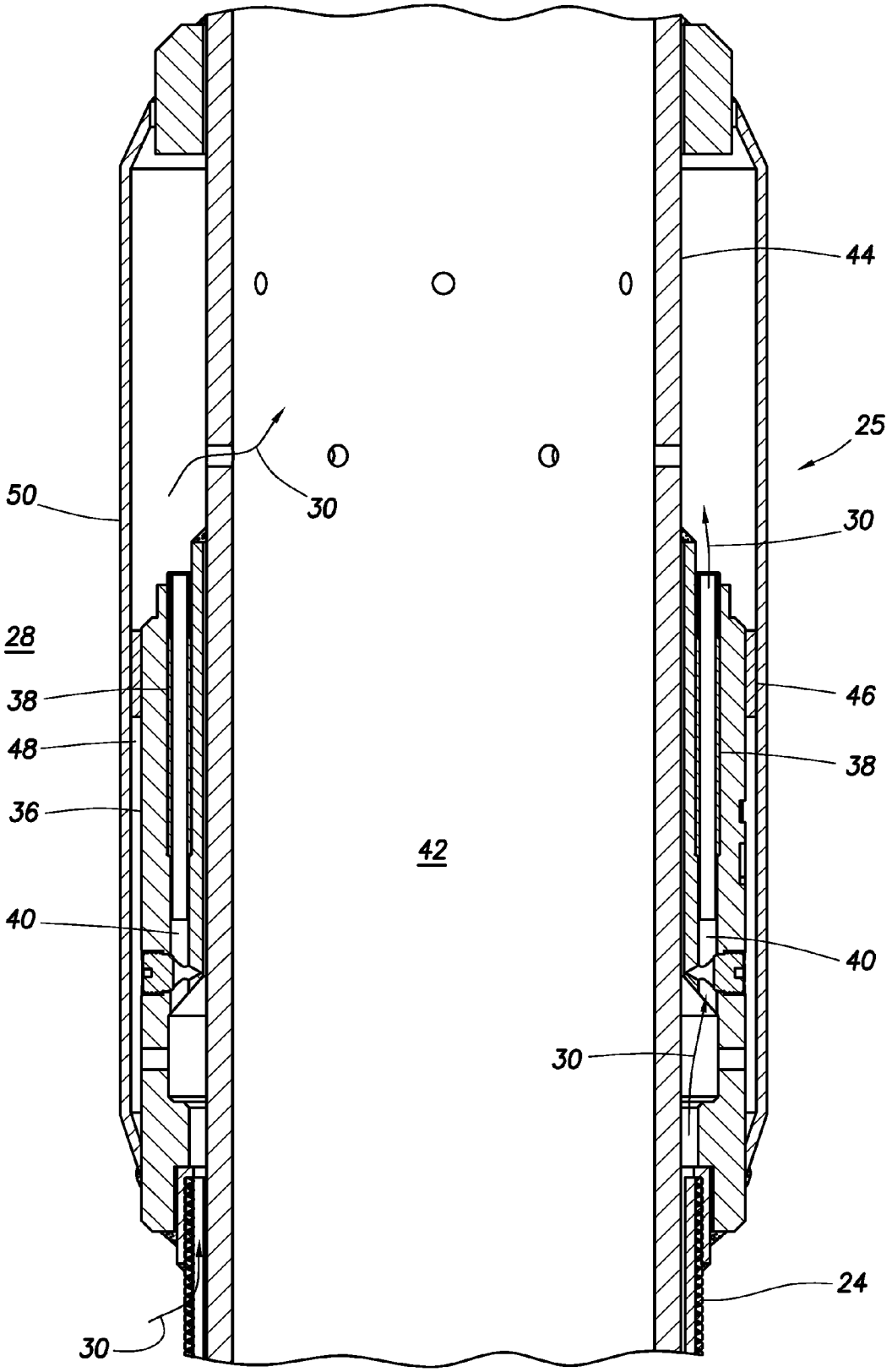
FIG. 6 is a representative cross-sectional view of another example of the variable flow restrictor system.

In FIG. 6, an example similar in many respects to that of FIG. 3 is representatively illustrated. In the FIG. 6 example, a single annular shaped pressure barrier 46 is positioned to block flow through the annular space between the housing 36 and the sleeve 50.

Figure 9:
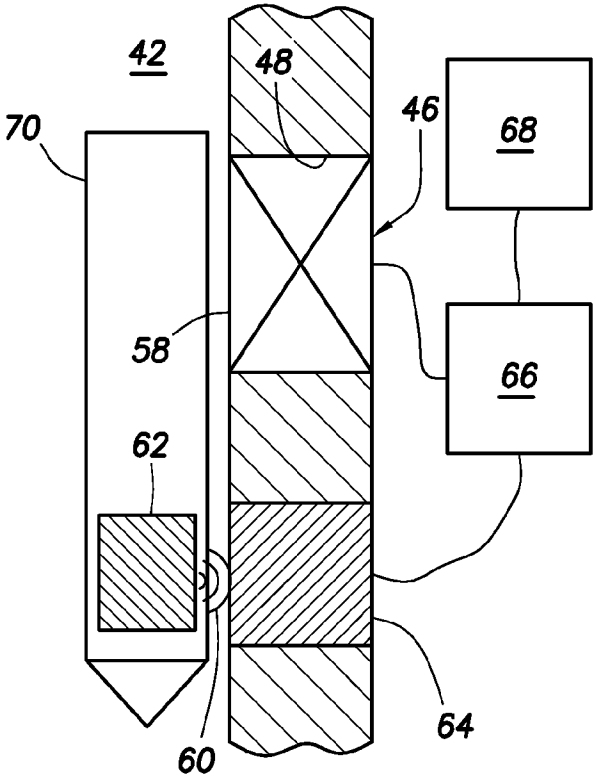
FIGS. 7-9 are representative cross-sectional views of examples of pressure barriers which may be used in the variable flow restrictor system.
Figure 8:
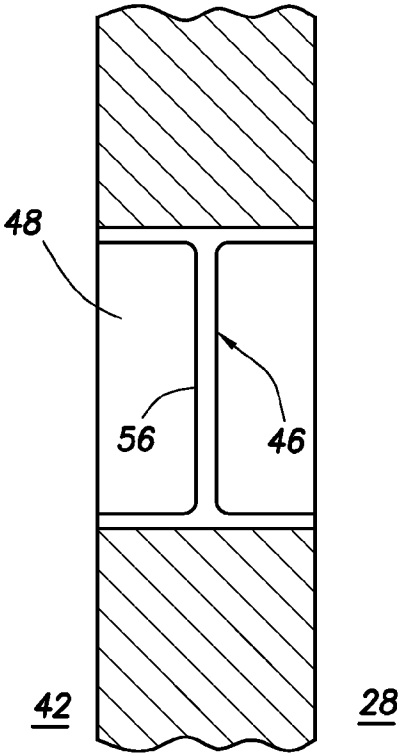
Figure 7:
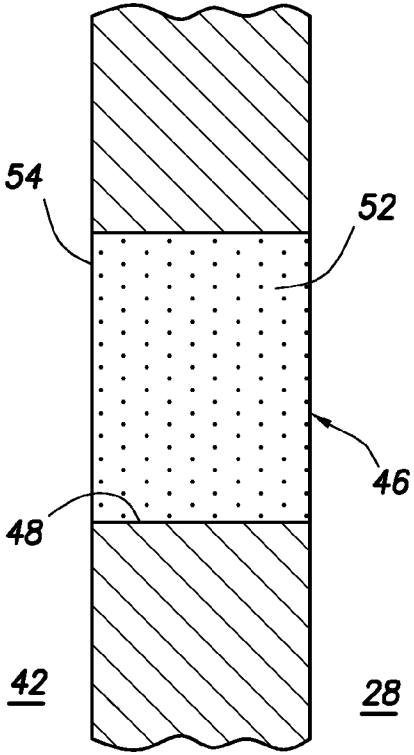

Representatively illustrated in FIGS. 7-9 are various different types of pressure barriers 46 which may be used in the flow restrictor system 25. These demonstrate that the scope of this disclosure is not limited to use of any particular type of pressure barrier in the system 25.

In FIG. 7, the pressure barrier 46 is in the form of a plug 54 which comprises a dissolvable or otherwise degradable material 52. For example, aluminum can be dissolved by contact with an acid, polylactic acid can be dissolved by contact with water at an elevated temperature, anhydrous boron can be degraded by contact with water, etc. Any type of dissolvable or degradable material may be used in the plug 54, as desired.

A plug 54 can be dissolved by galvanic action, as described in U.S. Pat. No. 7,699,101, the entire disclosure of which is incorporated herein by this reference. An electrical current may be applied to the plug 54 to quicken or slow the galvanic dissolving of the plug, if desired.

In FIG. 8, the pressure barrier 46 is in the form of a rupture disk or other frangible barrier 56. The frangible barrier 56 blocks flow through the flow path 48 until a predetermined pressure differential is applied across the barrier, thereby causing the barrier to break. Any type of frangible barrier may be used, as desired.

In FIG. 9, the pressure barrier 46 is in the form of a valve 58 which opens when a predetermined signal 60 is transmitted from a transmitter 62 to a receiver or sensor 64 of the system 25. The signal 60 can be any type of signal (e.g., radio frequency, acoustic, electromagnetic, magnetic, chemical, etc.).

The sensor 64 is connected to a controller 66, which is supplied with electrical power from a power supply 68 (for example, batteries, a downhole generator, etc.). The controller 66 causes the valve 58 to actuate open, in response to the signal 60 being detected by the sensor 64.

Suitable valves for use in the system 25 of FIG. 9 are described in US Publication No. 2010-0175867, the entire disclosure of which is incorporated herein by this reference. Any type of valve may be used for the pressure barrier 46 in the system 25, as desired.

The transmitter 62 can be conveyed into close proximity to the system 25 by, for example, enclosing the transmitter in a dart, a wireline tool, or another structure 70 dropped, lowered or otherwise displaced through the passage 42 to the system. Alternatively, the signal 60 could be transmitted from a remote location (such as the earth's surface or another location in the well), if desired.

It may now be fully appreciated that the above disclosure provides significant advancements to the art of variably restricting flow in a well. The system 25 described above allows for conveniently changing the resistance to flow through the system (e.g., between the interior and exterior of the system). In examples described above, this change can be made without intervening into the well. However, intervention can be used in other examples, if desired.

A method of variably restricting flow in a subterranean well is described above. In one example, the method can include: resisting flow through a first flow path 40; and then selectively opening a pressure barrier 46 which previously prevented flow through a second flow path 48. The first and second flow paths 40, 48 are configured for parallel flow.

A flow restrictor 38 can permit flow through the first flow path 40.

The first and second flow paths 40, 48 may conduct flow between an interior and an exterior of a tubular string 22 in the well.

The first and second flow paths 40, 48 may receive fluid 30 from a screen 24.

The pressure barrier 46 may comprise a valve 58, a dissolvable plug 54, a degradable plug 54 and/or a frangible barrier 56.

The selectively opening can include breaking a frangible barrier 56 in response to application of a predetermined pressure differential.

The selectively opening can include dissolving the plug 54 by contacting the plug 54 with acid.

The selectively opening can include dissolving the plug 54 by contacting the plug 54 with water at an elevated temperature.

The selectively opening can include opening the pressure barrier 46 in response to a signal 60 transmitted to a sensor 64 of the system 25. The signal 60 can comprise a radio frequency signal.

Also described above is a flow restrictor system 25 for use with a subterranean well. The system 25 can include at least first and second flow paths 40, 48 configured for parallel flow, a flow restrictor 38 which resists flow through the first flow path 40, and a pressure barrier 46 which prevents flow through the second flow path 48. The pressure barrier 46 is selectively openable to permit flow through the second flow path 48.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A flow restrictor system for use with a subterranean well, the system comprising:

at least first and second flow paths extending within an annular space formed between a base pipe and a sleeve surrounding the base pipe, wherein the first and second flow paths extend an equal distance longitudinally through the annular space;

a housing defined radially between the base pipe and the sleeve, wherein the first flow path is defined through the housing and wherein at least a portion of the second flow path is defined radially between the sleeve and the housing;

a flow restrictor secured in the housing which resists flow through the first flow path; and a pressure barrier which prevents flow through the second flow path, the pressure barrier being selectively openable to permit flow through the second flow path, wherein at least a portion of the second flow path is radially outward from the flow restrictor with respect to the base pipe.

2. The system of claim 1, wherein the flow restrictor permits flow through the first flow path.

3. The system of claim 1, wherein the first and second flow paths conduct flow between an interior and an exterior of a tubular string in the well.

4. The system of claim 1, wherein the pressure barrier comprises a frangible barrier which breaks in response to application of a predetermined pressure differential.

5. The system of claim 1, wherein the pressure barrier comprises a dissolvable plug.

6. The system of claim 5, wherein the plug dissolves in response to contact with acid.

7. The system of claim 1, wherein the pressure barrier comprises a degradable plug.

8. The system of claim 1, wherein the pressure barrier opens in response to a signal transmitted to a sensor of the system.

9. The system of claim 8, wherein the signal comprises a radio frequency signal.

10. The system of claim 1, wherein the first and second flow paths receive fluid from a screen.

11. The system of claim 1, wherein the pressure barrier comprises a valve.

12. A method of variably restricting flow in a subterranean well, the method comprising:

resisting flow through a first flow path; and then selectively opening a pressure barrier which previously prevented flow through a second flow path, wherein the first and second flow paths extend within an annular space formed between a base pipe and a sleeve surrounding the base pipe, wherein the first and second flow paths extend an equal distance longitudinally through the annular space, wherein a flow restrictor secured in a housing resists flow through the first flow path, and wherein at least a portion of the second flow path is radially between the sleeve and the housing and radially outward from the flow restrictor with respect to the base pipe.

13. The method of claim 12, wherein the pressure barrier comprises a valve.

14. The method of claim 12, wherein a flow restrictor permits flow through the first flow path.

15. The method of claim 12, wherein the first and second flow paths conduct flow between an interior and an exterior of a tubular string in the well.

16. The method of claim 12, wherein the pressure barrier comprises a frangible barrier, and wherein the selectively opening comprises breaking the frangible barrier in response to application of a predetermined pressure differential.

17. The method of claim 12, wherein the pressure barrier comprises a dissolvable plug.

18. The method of claim 17, wherein the selectively opening comprises dissolving the plug by contacting the plug with acid.

19. The method of claim 17, wherein the selectively opening comprises dissolving the plug by contacting the plug with water at an elevated temperature.

20. The method of claim 12, wherein the pressure barrier comprises a degradable plug.

21. The method of claim 12, wherein the selectively opening comprises opening the pressure barrier in response to a signal transmitted to a sensor of the system.

22. The method of claim 21, wherein the signal comprises a radio frequency signal.

23. The method of claim 12, wherein the first and second flow paths receive fluid from a screen.

* * * * *